US011484937B2

(12) United States Patent
Park

(10) Patent No.: US 11,484,937 B2
(45) Date of Patent: Nov. 1, 2022

(54) VENTILATOR FOR CASTING MOLD

(71) Applicant: Dae Geun Park, Ulsankwangyeok-si (KR)

(72) Inventor: Dae Geun Park, Ulsankwangyeok-si (KR)

( * ) Notice: Subject to any disclaimer, the term of this patent is extended or adjusted under 35 U.S.C. 154(b) by 22 days.

(21) Appl. No.: 17/318,451

(22) Filed: May 12, 2021

(65) Prior Publication Data

US 2022/0118505 A1 Apr. 21, 2022

(30) Foreign Application Priority Data

Oct. 19, 2020 (KR) ..... 10-2020-0134985

(51) Int. Cl.
*B22C 9/06* (2006.01)

(52) U.S. Cl.
CPC ..... *B22C 9/067* (2013.01)

(58) Field of Classification Search
CPC ..... B22C 9/067; B22D 45/00; B22D 45/005
See application file for complete search history.

(56) References Cited

FOREIGN PATENT DOCUMENTS

| | | |
|---|---|---|
| KR | 2019990021684 | 6/1999 |
| KR | 102095729 | 4/2020 |
| KR | 102095732 | 4/2020 |
| KR | 102095727 | 5/2020 |

OTHER PUBLICATIONS

English translation of KR 102095732 B1 (Year: 2020).*

* cited by examiner

*Primary Examiner* — Kevin P Kerns
*Assistant Examiner* — Steven S Ha
(74) *Attorney, Agent, or Firm* — IPLA P.A.

(57) ABSTRACT

A ventilator for a casting mold is mounted on an exhaust pipe (11) of a mold (10) to emit gas generated when melt is injected into a molding space (12). The ventilator for a casting mold has exhaust holes which are improved in arrangement structure and are shorter than a cylindrical body part so as to enhance gas emission efficiency and prevent transformation of the exhaust holes, and has a buffering space part formed inside a cylindrical body part to spread and accept melt coming through the exhaust holes so as to effectively prevent a damage of a mold caused by external leakage of the melt. The ventilator for the casting mold includes a cylindrical body part (100) and a fixed type exhaust block (20).

4 Claims, 8 Drawing Sheets

VENTILATOR FOR CASTING MOLD

BACKGROUND

The present invention relates to a ventilator for a casting mold, and more particularly, to a ventilator for a casting mold, which has exhaust holes of an improved arrangement structure being shorter than a cylindrical body part so as to enhance gas emission efficiency and prevent transformation of the exhaust holes, and which has a buffering space part formed inside the cylindrical body part to spread and receive melt coming through the exhaust holes so as to effectively prevent a damage of a mold caused by external leakage of the melt.

In general, a ventilator is configured to make a flow of a fluid flow only in one direction through fine holes parallel to each other, and is used to expel air or generated gas in a mold for sound casting without any defect, such as bad pouring, formation of cold shut, and others in gravity casting, low pressure casting, and plastic injection molding.

Meanwhile, because such a ventilator is manufactured through compression of powder, micropores are formed inside the ventilator, and it considerably deteriorates durability. When the ventilator is fit to a mold which is used for casting, the ventilator is formed to be a little larger than a groove of the mold to prevent separation. However, when the ventilator is fit to the mold, because a hole where gas moves is transformed or the entire form of the mold is deformed due to a long-term use, the ventilator is difficult to perform its role since the ventilator is separated or gas is not emitted smoothly due to distortion of the hole.

Therefore, the inventor of the present invention has obtained a patent right, Korean Patent No. 10-2095729, disclosing a technology of a two-body type ventilator which can enhance quality of a molded product by stably emitting generated gas to the outside when performing molding by pouring aluminum melt into a molding space of a mold. Moreover, the inventor of the present invention has obtained a patent right, Korean Patent No. 10-2095727, disclosing a technology of a ventilator which has durability and improves economic efficiency through a partial replacement.

However, the conventional arts have several disadvantages as follows. Because a hole section for emitting gas is long and a pin for forming the hole is thin, the hole gets bent during penetration through the hole. Therefore, after completion of machining, there may occur overlap of the holes due to irregular arrangement of the holes or leaning of the holes due to concentration on an edge, and it makes gas emission efficiency deteriorated and it makes molding time delayed since it takes long time to perfectly emit gas.

PATENT DOCUMENTS

Patent Document 1: Korean Patent No. 10-2095729 B1 (Mar. 26, 2020)

Patent Document 2: Korean Patent No. 10-2095727 B1 (Mar. 26, 2020)

SUMMARY OF THE INVENTION

Accordingly, the present invention has been made to solve the above-mentioned problems occurring in the prior arts, and it is an object of the present invention to provide a ventilator for a casting mold, which has exhaust holes of an improved arrangement structure being shorter than a cylindrical body part so as to enhance gas emission efficiency and prevent transformation of the exhaust holes, and which has a buffering space part formed inside the cylindrical body part to spread and accept melt coming through the exhaust holes so as to effectively prevent a damage of a mold caused by external leakage of the melt.

To accomplish the above object, according to the present invention, there is provided a ventilator for a casting mold which is mounted on an exhaust pipe of a mold in order to emit gas generated when melt is injected into a molding space, the ventilator including: a cylindrical body part which is made of an SUS material and has a knurling part formed on an outer circumferential surface thereof to be forcedly fit to the exhaust pipe and a main flow passage formed therein to allow gas to flow; and a fixed type exhaust block which is formed integrally with an upper area of the main flow passage of the cylindrical body part and has a plurality of upper exhaust holes for gas emission, wherein the upper exhaust holes are 30% to 50% of the length of the cylindrical body part and are arranged in zigzags, and a separable exhaust block is inserted into a lower area of the main flow passage of the cylindrical body part, and has a plurality of lower exhaust holes for gas emission.

Moreover, a buffering space part is formed in a gap between the fixed type exhaust block and the separable exhaust block, and is disposed to receive melt flowing through the lower exhaust holes.

Furthermore, the separable exhaust block has the porous block formed through compression of powder, and the porous block includes a first inclined plane which has a diameter reduced upward, an inner diameter of the lower area of the main flow passage receiving the separable exhaust block has a second inclined plane which has a diameter reduced upwards, a diameter of a lower end portion of the lower area of the main flow passage is larger than a diameter of a lower end portion of the separable exhaust block, and a stop ring is mounted at the lower end portion of the lower area of the main flow passage to restrain the separable exhaust block.

Additionally, the separable exhaust block is disposed to be movable in the lower area of the main flow passage due to a loose fitting tolerance by a difference in diameter with the lower area of the main flow passage, and when the melt is injected into the molding space, while the separable exhaust block moves upwards along the lower area of the main flow passage by pressure of gas and the melt, gas is emitted through the lower exhaust holes and porous gaps in a state where the first and second inclined planes engage with each other and are fixed in position.

According to the present invention, the ventilator for a casting mold has the exhaust holes which are improved in arrangement structure and are shorter than a cylindrical body part so as to enhance gas emission efficiency and prevent transformation of the exhaust holes, and has a buffering space part formed inside the cylindrical body part to spread and accept melt coming through the exhaust holes so as to effectively prevent a damage of a mold caused by external leakage of the melt.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, preferred embodiments of the present invention will be described in detail with reference to the accompanying drawings. In description of the invention, a detailed explanation of known related functions and constitutions may be omitted to avoid unnecessarily obscuring the subject matter of the present invention.

Figure 1:
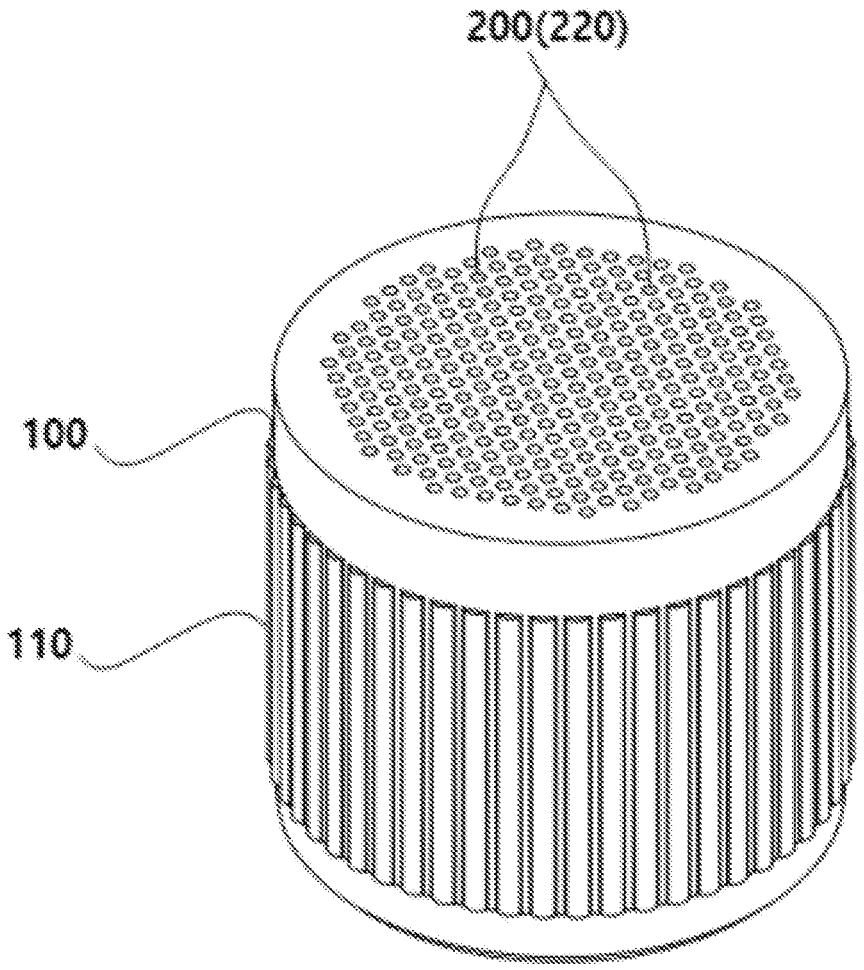
FIG. 1 is a perspective view showing a ventilator for a casting mold according to a preferred embodiment of the present invention.
Figure 2:
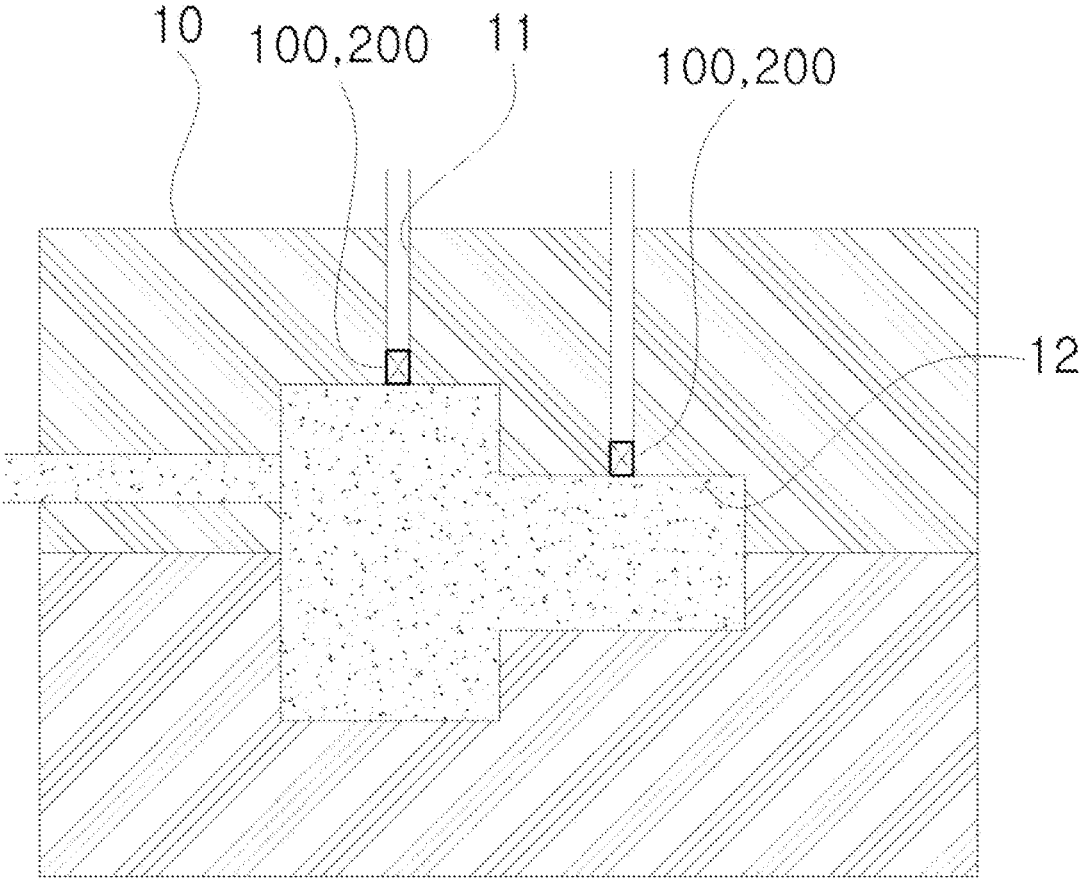
FIG. 2 is a view showing an installed state of the ventilator for the casting mold according to the preferred embodiment of the present invention.
Figure 3A:
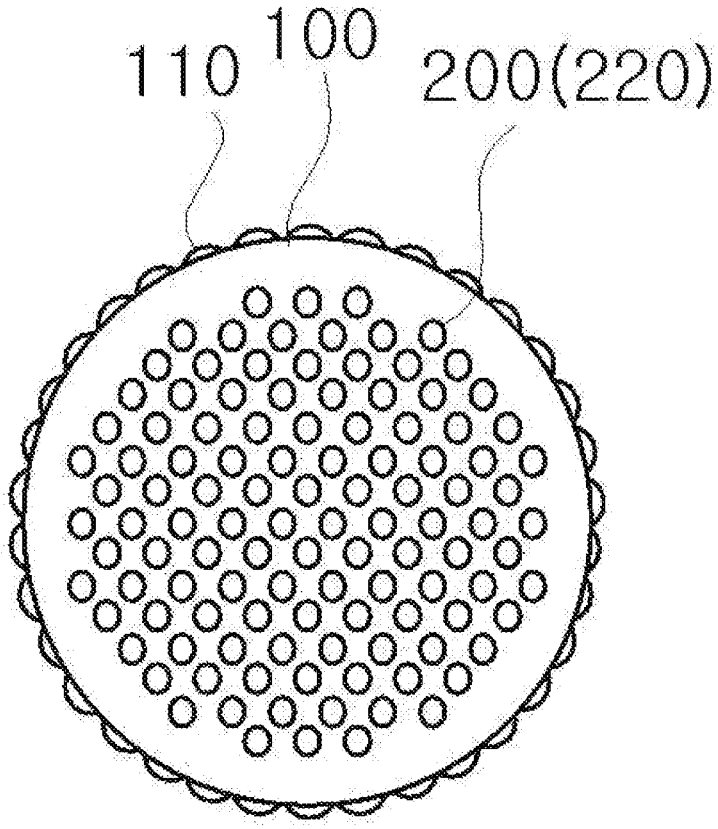
FIG. 3A is a plan view and FIGS. 3B and 3C are front views showing the ventilator for the casting mold according to the preferred embodiment of the present invention.
Figure 3B:
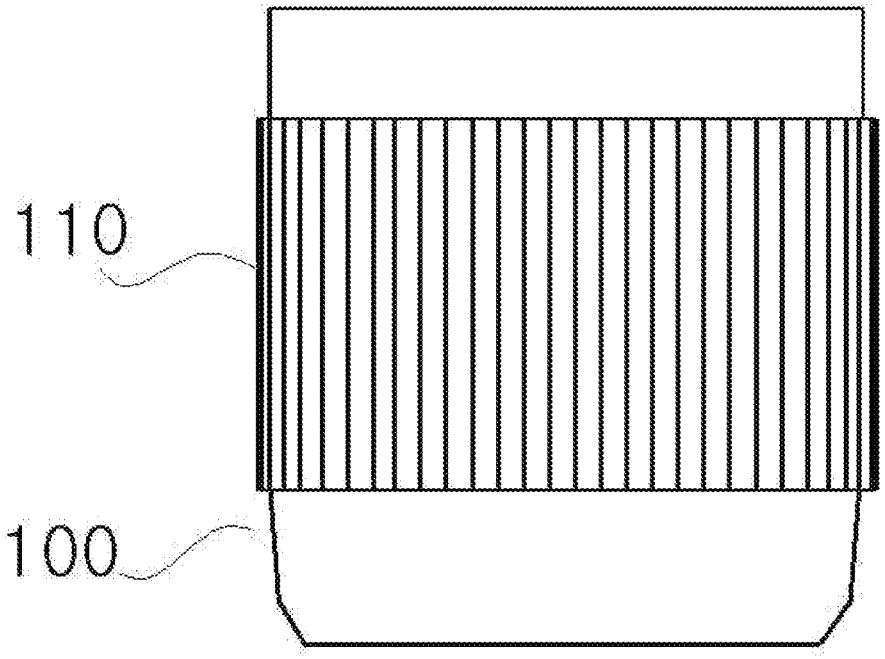
Figure 3C:
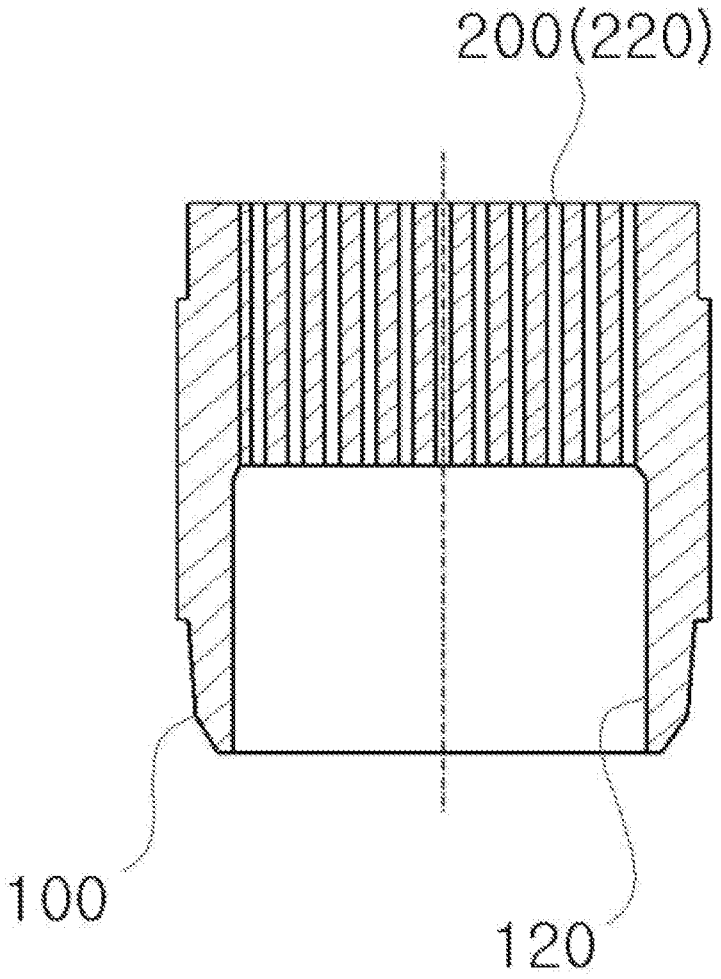
Figure 4:
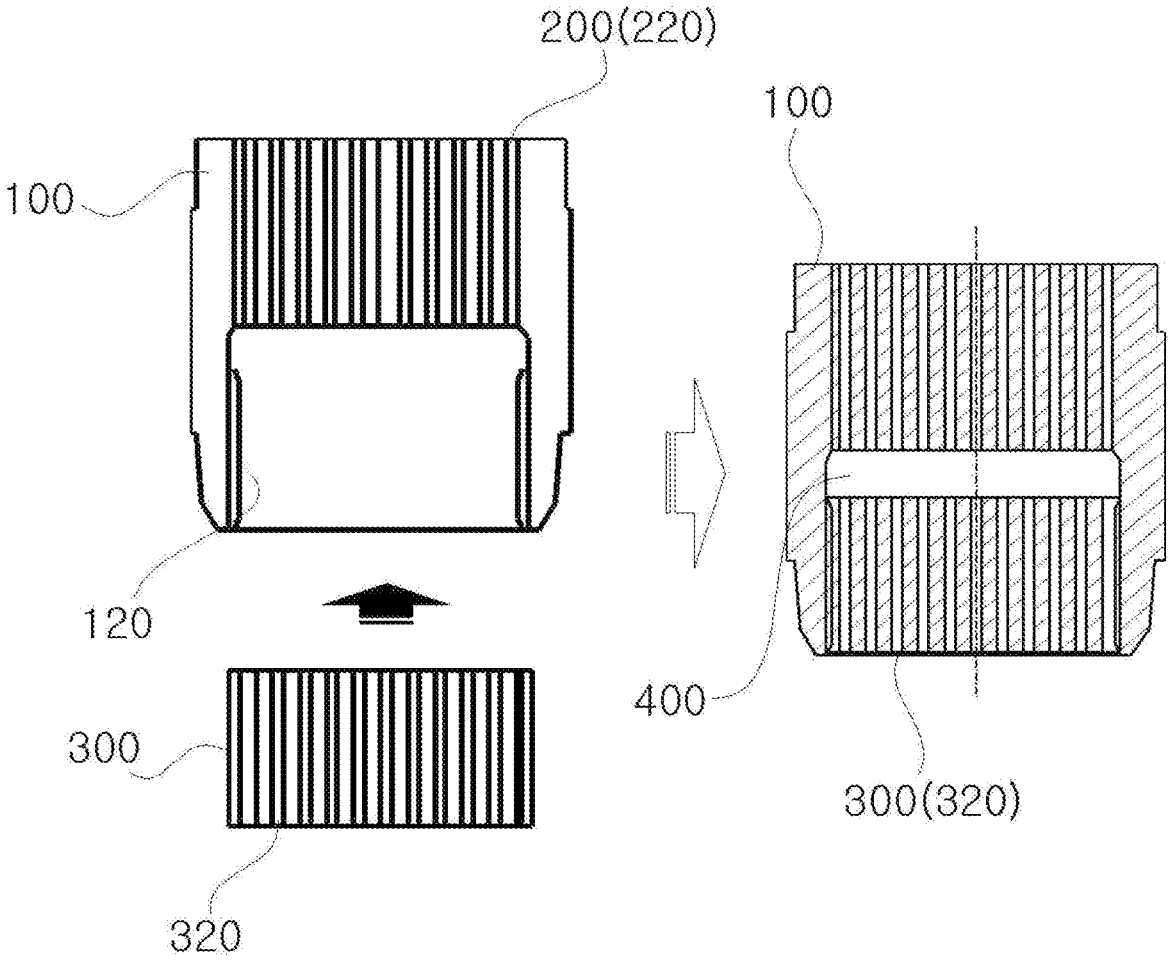
FIG. 4 is a view showing an internal structure of the ventilator for the casting mold according to the preferred embodiment of the present invention.
Figure 5A:
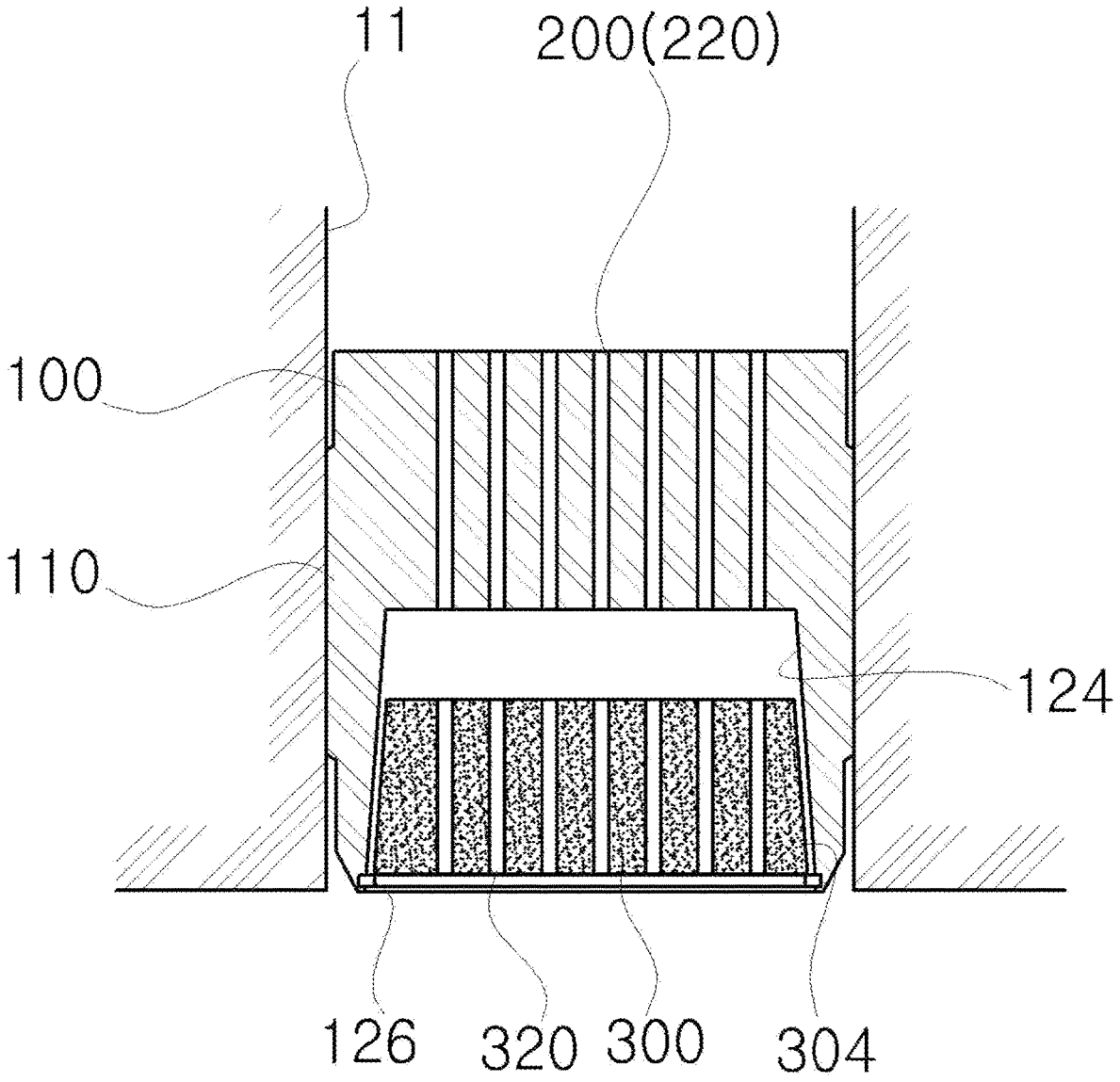
FIGS. 5A and 5B are views showing a porous block of a ventilator for a casting mold according to a modification of the present invention.
Figure 5B:
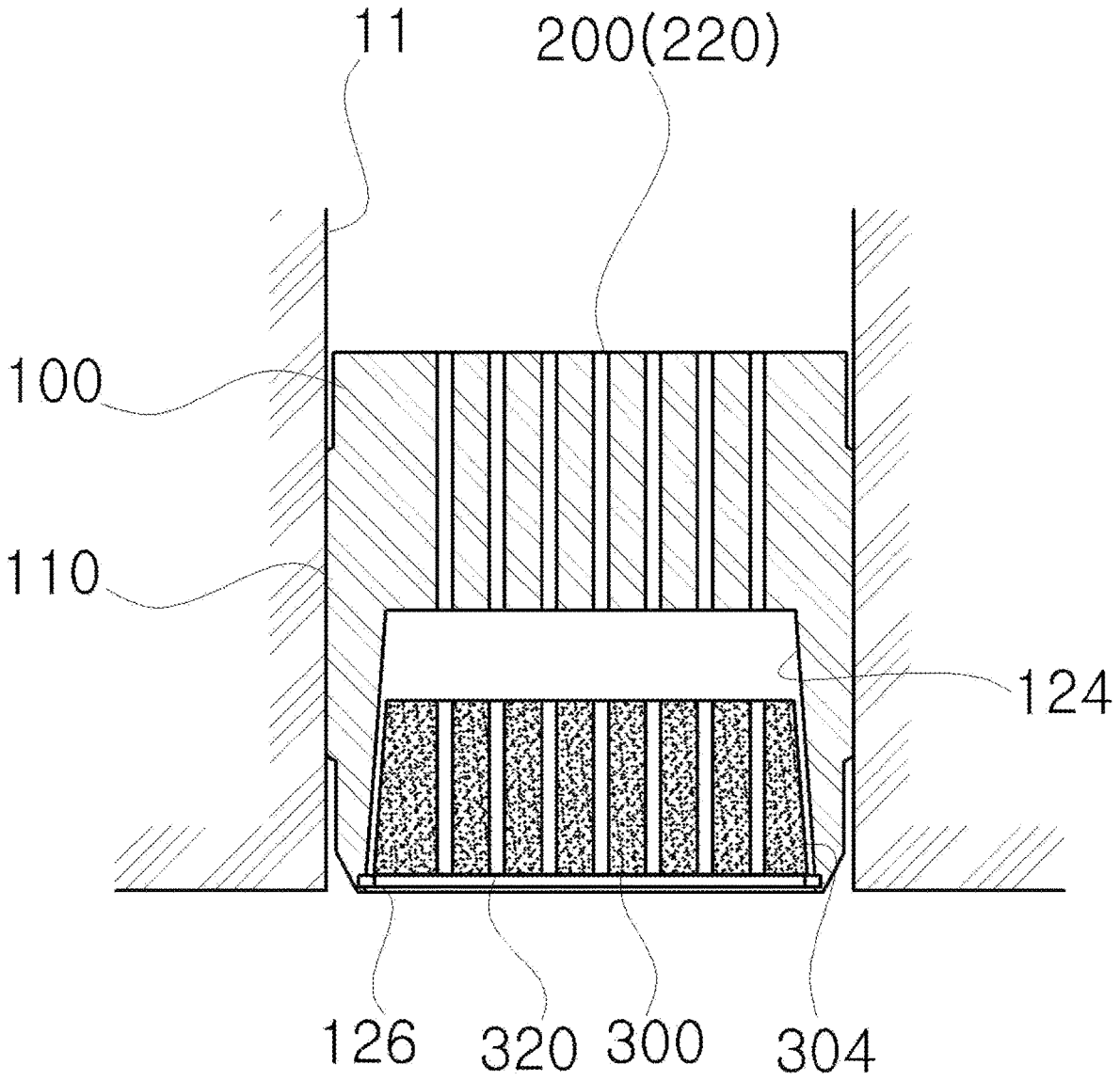

FIG. 1 is a perspective view showing a ventilator for a casting mold according to a preferred embodiment of the present invention, FIG. 2 is a view showing an installed state of the ventilator for the casting mold according to the preferred embodiment of the present invention, FIG. 3A is a plan view and FIGS. 3B and 3C are front views showing the ventilator for the casting mold according to the preferred embodiment of the present invention, FIG. 4 is a view showing an internal structure of the ventilator for the casting mold according to the preferred embodiment of the present invention, and FIGS. 5A and 5B are views showing a porous block of a ventilator for a casting mold according to a modification of the present invention.

The present invention relates to a ventilator for a casting mold, which is mounted on an exhaust pipe 11 of a mold 10 to emit gas generated when melt is injected into a molding space 12. The ventilator for a casting mold has exhaust holes which are improved in arrangement structure and are shorter than a cylindrical body part so as to enhance gas emission efficiency and prevent transformation of the exhaust holes, and has a buffering space part formed inside a cylindrical body part to spread and accept melt coming through the exhaust holes so as to effectively prevent a damage of a mold caused by external leakage of the melt. The ventilator for the casting mold includes a cylindrical body part 100 and a fixed type exhaust block 20.

The cylindrical body part 100 is made of an SUS material, and includes a knurling part 110 formed on an outer circumferential surface thereof to be forcedly fit to the exhaust pipe 11 and a main flow passage 120 formed therein to allow gas to flow.

The cylindrical body part 100 is formed integrally with the fixed type exhaust block 200, which will be described later, and is manufactured using press forging so as to improve strength and durability and maintain uniform quality.

Moreover, because the knurling part 110 is formed integrally with the outer circumferential surface of the cylindrical body part 100, the ventilator is not separated from the mold after being inserted into the mold exhaust pipe 11. When the cylindrical body part 100 is forcedly fit to the mold exhaust pipe 11, the fitting pressure is dispersed by transformation of the knurling part 110 so that transformation of upper exhaust holes 220 is prevented.

Furthermore, the fixed type exhaust block 200 according to the preferred embodiment of the present invention is formed integrally with an upper area of the main flow passage 120 of the cylindrical body part 100, and includes a plurality of upper exhaust holes 220 for gas emission. That is, the fixed type exhaust block 200 is molded of an SUS material by press forging in order to improve strength and durability and to maintain uniform quality, for instance, to prevent overlap of the holes due to irregular arrangement of the holes or leaning of the holes due to concentration on an edge.

In this instance, the upper exhaust holes 220 are 30% to 50% of the length of the cylindrical body part 100, and are arranged in zigzags.

As described above, because the upper exhaust holes 220 are formed to be shorter, it prevents overlap of the holes due to irregular arrangement of the holes or leaning of the holes due to concentration on an edge. Additionally, because the upper exhaust holes 220 are arranged in zigzags, under a condition that the number of the exhaust holes 220 is the same, intervals among the exhaust holes 220 are expanded to prevent transformation.

Meanwhile, the melt is discharged together with gas if the length of the upper exhaust holes 220 is less than 30% of the length of the cylindrical body part 100, and gas emission efficiency is deteriorated if the length of the upper exhaust holes 220 exceeds 50% of the length of the cylindrical body part 100. So, it is preferable to form the upper exhaust holes 220 to be 30% to 50% of the length of the cylindrical body part 100.

In FIG. 4, the ventilator further includes a separable exhaust block 300, which is inserted into a lower area of the main flow passage 120 of the cylindrical body part 100 and has a plurality of lower exhaust holes 320 for gas emission. The lower exhaust holes 320 may be made of the same SUS material as the upper exhaust holes 220 or may be a porous block 302 made by compression of powder.

Moreover, a buffering space part 400 is formed in a gap between the fixed type exhaust block 200 and the separable exhaust block 300.

The buffering space part 400 is disposed to receive the melt flowing in through the lower exhaust holes 320. That is, the buffering space part 400 spreads and receives the melt coming through the lower exhaust holes so as to effectively prevent a damage of the mold caused by external leakage of the melt. Especially, while gas is emitted through the lower exhaust holes 320, a small amount of the melt is collected into the buffering space part 400 and the lower exhaust holes 320 are always maintained to be open, so it prevents a bad gas emission.

In FIG. 5, the separable exhaust block 300 has the porous block 302 formed through compression of powder.

The porous block 302 includes a first inclined plane 304 which has a diameter reduced upwards. An inner diameter of the lower area of the main flow passage 120 receiving the separable exhaust block 300 has a second inclined plane 124 which has a diameter reduced upwards.

Furthermore, a diameter of a lower end portion of the lower area of the main flow passage 120 is larger than a diameter of a lower end portion of the separable exhaust block 300.

In this instance, a stop ring 126 is mounted at the lower end portion of the lower area of the main flow passage 120 to restrain the separable exhaust block 300.

As described above, the separable exhaust block 300 is disposed to be movable in the lower area of the main flow passage 120 due to a loose fitting tolerance by a difference in diameter with the lower area of the main flow passage 120. So, even though impact is applied to forcedly fit the cylindrical body part 100 to the exhaust pipe 11, the separable exhaust block 300 is moved in the lower area of the main flow passage 120 in order to be protected from the impact and to be prevented from a damage.

Additionally, when the melt is injected into the molding space 12, while the separable exhaust block 300 moves upwards along the lower area of the main flow passage 120 by pressure of gas and the melt, gas is emitted through the lower exhaust holes 320 and porous gaps in a state where the first and second inclined planes 304 and 124 engage with each other and are fixed in position.

The porous block 302 made through compression of powder, which is limited in application to the casting mold field due to the shortcoming that it is excellent at gas emission efficiency but is not durable, is combined with the cylindrical body part 100 and the fixed type exhaust block 200 which are made of the SUS material in order to make up for the shortcoming of the porous block 302 and to maximize gas emission efficiency.

As described above, while the present invention has been particularly shown and described with reference to the example embodiments thereof, it will be understood by those of ordinary skill in the art that various changes, modifications and equivalents may be made in the present invention without departing from the technical scope and idea of the present invention. Therefore, it would be understood that the present invention is not limited to the embodiments but the protective scope of the present invention belongs to the following claims and equivalents.

What is claimed is:

1. A ventilator for a casting mold which is mounted on an exhaust pipe of a mold in order to emit gas generated when melt is injected into a molding space, the ventilator comprising:

a cylindrical body part which is made of an SUS material and has a knurling part formed on an outer circumferential surface thereof to be forcedly fit to the exhaust pipe and a main flow passage formed therein to allow gas to flow; and a fixed type exhaust block which is formed integrally with an upper area of the main flow passage of the cylindrical body part and has a plurality of upper exhaust holes for gas emission, wherein the upper exhaust holes are 30% to 50% of the length of the cylindrical body part and are arranged in zigzags, and wherein a separable exhaust block is inserted into a lower area of the main flow passage of the cylindrical body part, and has a plurality of lower exhaust holes for gas emission.

2. The ventilator according to claim 1, wherein a buffering space part is formed in a gap between the fixed type exhaust block and the separable exhaust block, and is disposed to receive melt flowing through the lower exhaust holes.

3. The ventilator according to claim 2, wherein the separable exhaust block has the porous block formed through compression of powder, and the porous block includes a first inclined plane which has a diameter reduced upward, an inner diameter of the lower area of the main flow passage receiving the separable exhaust block has a second inclined plane which has a diameter reduced upwards, a diameter of a lower end portion of the lower area of the main flow passage is larger than a diameter of a lower end portion of the separable exhaust block, and a stop ring is mounted at the lower end portion of the lower area of the main flow passage to restrain the separable exhaust block.

4. The ventilator according to claim 3, wherein the separable exhaust block is disposed to be movable in the lower area of the main flow passage due to a loose fitting tolerance by a difference in diameter with the lower area of the main flow passage, and when the melt is injected into the molding space, while the separable exhaust block moves upwards along the lower area of the main flow passage by pressure of gas and the melt, gas is emitted through the lower exhaust holes and porous gaps in a state where the first and second inclined planes engage with each other and are fixed in position.

* * * * *